United States Patent [19]

Koizumi et al.

[11] 4,211,045

[45] Jul. 8, 1980

[54] BUILDING STRUCTURE

[75] Inventors: Hajime Koizumi, Tokyo; Kozo Toyama, Tama; Mikio Kobayashi; Hajime Hatano, both of Hachiooji; Toshio Saeki, Tama; Kaoru Mizukoshi, Hino; Shinichi Tamanaga; Keizo Miyakawa, both of Kodaira; Tomoyasu Kato, Tokyo, all of Japan

[73] Assignee: Kajima Kensetsu Kabushiki Kaisha, Tokyo, Japan

[21] Appl. No.: 858,198

[22] Filed: Dec. 7, 1977

[30] Foreign Application Priority Data

| | | | |
|---|---|---|---|
| Jan. 20, 1977 | [JP] | Japan | 52-5198 |
| Mar. 17, 1977 | [JP] | Japan | 52-30112 |
| May 24, 1977 | [JP] | Japan | 52-66452[U] |
| May 24, 1977 | [JP] | Japan | 52-66453[U] |
| May 24, 1977 | [JP] | Japan | 52-66454[U] |

[51] Int. Cl.[2] ..... E04B 5/19

[52] U.S. Cl. ..... 52/251; 52/260; 52/319; 52/432; 52/602

[58] Field of Search ..... 52/319, 724, 250, 251, 52/252, 253, 259, 260, 319, 602, 414, 432, 433, 334, 583, 587; 249/28, 29, 30, 31

[56] References Cited

U.S. PATENT DOCUMENTS

| | | | |
|---|---|---|---|
| 863,555 | 8/1907 | Poole | 52/602 |
| 938,458 | 11/1909 | Brockhausen | 52/250 |
| 947,769 | 1/1910 | Conzelman | 52/602 |
| 980,480 | 1/1911 | Bishop | 52/260 |
| 1,031,044 | 7/1912 | Conzelman | 52/602 |
| 1,031,046 | 7/1912 | Conzelman | 52/602 |
| 1,135,721 | 4/1915 | Robinson | 52/259 |
| 1,430,424 | 9/1922 | Wells | 52/252 |
| 1,794,079 | 2/1931 | Kellett | 52/252 |
| 2,731,824 | 1/1956 | Hadley | 52/252 |
| 3,349,539 | 10/1967 | Cheskin | 52/251 |

FOREIGN PATENT DOCUMENTS

| | | | |
|---|---|---|---|
| 188088 | 12/1956 | Austria | 52/250 |
| 788513 | 7/1935 | France | 52/724 |
| 1257858 | 2/1961 | France | 52/319 |
| 1475696 | 2/1967 | France | 52/251 |
| 135688 | 12/1919 | United Kingdom | 52/253 |

*Primary Examiner*—John E. Murtagh

*Attorney, Agent, or Firm*—Meyer, Tilberry & Body

[57] ABSTRACT

A building structure including a beam of steel or rod reinforced concrete which is sheathed in a U-shaped cross section steel shell, a concrete column which is encased in a steel tube, diagonal bracings and connecting members thereof. The topside of the U-shaped steel shell is open to allow concrete to be filled therethrough. Steel rods are placed in the shell and a steel panel connecting member secures the opposed sidewalls of the shell. Steel bars extend from a floor slab into the beam shell through the aforesaid open topside, thereby rendering the beam integral with the slab. Frame-like steel members for confining reinforcing bars and/or shear connectors are disposed in the inside of the beam shell. A steel sleeve is also provided in the beam shell for defining a space for disposition of equipment. In addition, an opening is provided in the bottom wall of the beam shell so as to allow steel rods to extend from the wall into the beam shell, thereby rendering the beam integral with the wall. A column is coupled to the beam by means of ring stiffeners or gusset plates. Diagonal bracings are positioned in symmetric relation to the frame member of the beam or column, and the diagonal bracings are fastened to the frame member of the beam or column by means of long bolts extending through the frame member thereof. The tip portions of diagonal bracings are provided with anchor members which are embedded in the concrete contained in the beam shell.

2 Claims, 45 Drawing Figures

BUILDING STRUCTURE

BACKGROUND OF THE INVENTION

This invention relates to a steel bar reinforced concrete building structure which is encased in a shell made of a steel plate.

Steel reinforced concrete structures are well known in the prior art. However, from the standpoint of material expense, the reinforced concrete structure is relatively inexpensive, but the labor cost is high. On the other hand, the steel frame structures are high in material cost, but low in labor cost because of the ease of assembly of steel structural members.

Accordingly, there has been a long felt need for a structure with material cost comparable to a reinforced concrete structure annd labor costs comparable to a steel frame structure. It has, therefore, been hitherto a common practice to use a beam construction which is sheathed in a U-shaped precast plate and a column construction which is sheathed in a steel tube. However, this prior art construction suffers from various shortcomings such as difficulty in fabrication and has not been widely used.

The present invention overcomes all such problems and provides a new building structure which combines the advantages of both reinforced concrete and steel frame structures.

SUMMARY OF THE INVENTION

It is accordingly an object of the present invention to provide a building structure which facilitates erection on a construction site, and provides desired strength, stiffness and ductility of the structure, with accompanying reduction in construction cost.

It is another object of the present invention to provide a building structure which shortens construction time, with resulting reduction in cost.

It is still another object of the present invention to provide a building structure which reduces the required amount of fire resisting coating, as compared with fire proofing a conventional steel frame structure.

It is yet another object of the present invention to provide a building structure which provides increased strength of the joint between a beam and a column or wall.

It is a further object of the present invention to provide a building structure which provides for easy attachment of diagonal bracings and provides increased strength of joints between diagonal bracings and a beam or column.

These and other objects and features of the present invention will be apparent from a reading of the ensuing specification in conjunction with the accompanying drawings which indicate the embodiments of the invention. In the drawings, like parts are designated by like reference numerals throughout the drawings.

BRIEF DESCRIPTION OF THE DRAWINGS

FIGS. 13-16 are views showing a second embodiment of the invention; in which FIG. 13 is a fragmentary elevational cross sectional view; FIG. 14 is a fragmentary sectional plan view taken along the line 14—14 of FIG. 13; and FIGS. 15 and 16 are fragmentary elevational cross sectional views showing modifications of the embodiment of FIG. 13;

FIGS. 17 and 18 are views showing a third embodiment of the invention, in which FIG. 17 is a fragmentary elevational cross sectional view of a beam and a slab in longitudinal section, and FIG. 18 is a fragmentary elevational view in longitudinal section taken along the line 18—18 of FIG. 17;

FIGS. 19-23 are views showing a fourth embodiment of the invention, in which FIGS. 19-22 are fragmentary elevational cross sectional views of the beam and slab, and FIG. 23 is a fragmentary elevational view of the embodiment of FIG. 22;

FIGS. 24 and 25 are views illustrative of a fifth embodiment of the invention, in which FIG. 24 is a fragmentary elevational cross sectional view of a beam and a slab, and FIG. 25 is a fragmentary elevational view in longitudinal section taken along the line 25—25 of FIG. 24;

FIGS. 26 and 27 are views showing modifications of the fifth embodiment shown in FIGS. 24 and 25, in which FIG. 26 is a fragmentary elevational cross sectional view, and FIG. 27 is a fragmentary elevational view in longitudinal section taken along the line 27—27 of FIG. 26;

FIGS. 29-31 are views showing a seventh embodiment of the invention, in which FIG. 29 is a fragmentary elevational cross sectional view showing a beam and diagonal bracings, and FIG. 30 is a fragmentary elevational view in longitudinal section taken along the line 30—30 of FIG. 29, and FIG. 31 is a fragmentary elevational view in longitudinal section illustrative of a modification of the embodiment of FIG. 30;

FIGS. 32-34 are views showing an eighth embodiment of the invention, in which FIG. 32 is a fragmentary elevational cross section view showing a column and diagonal bracings, FIG. 33 is a fragmentary elevational view in longitudinal section showing a beam and diagonal bracings, and FIG. 34 is a fragmentary elevational cross sectional view taken along the line 34—34 of FIG. 33;

FIGS. 35–37 are views illustrative of a ninth embodiment of the invention, in which FIG. 35 is a fragmentary elevational partial cross sectional view showing the connection of a beam and a column, FIG. 36 is a fragmentary cross sectional plan view taken along the line 36—36 of FIG. 35, and FIG. 37 is a fragmentary elevational cross sectional view taken along the line 37—37 of FIG. 35;

FIGS. 38–41 are views showing a tenth embodiment of the invention, in which FIG. 38 is a fragmentary elevational cross sectional view showing the coupling of a beam and a column, FIG. 39 is a fragmentary cross sectional plan view taken along the line 39—39 of FIG. 38, FIG. 40 is a fragmentary cross sectional plan view taken along the line 40—40 of FIG. 38, FIG. 41 is a fragmentary elevational cross sectional view taken along the line 41—41 of FIG. 38; and, FIGS. 42–45 are views showing an eleventh embodiment of the invention, in which

DESCRIPTION OF THE PREFERRED EMBODIMENTS

Figure 1:
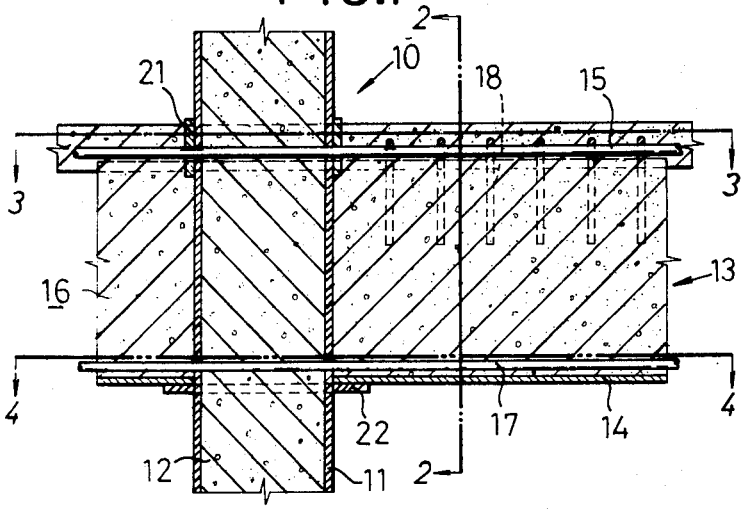
FIG. 1 is a fragmentary sectional view in elevation of a building structure of a first embodiment of the invention.
Figure 2:
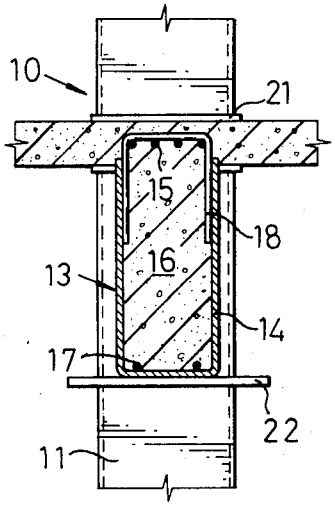
FIG. 2 is a fragmentary cross sectional view in elevation taken along the line 2—2 of FIG. 1.
Figure 3:
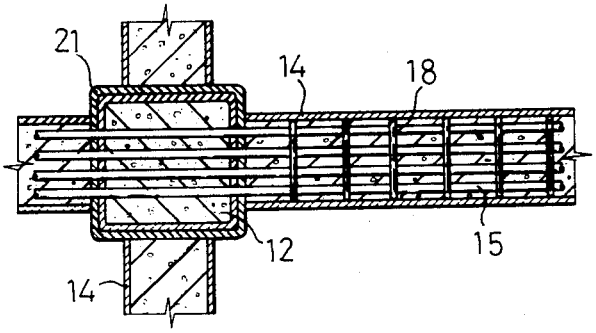
FIG. 3 is a fragmentary sectional plan view taken along the line 3—3 of FIG. 1.
Figure 5:
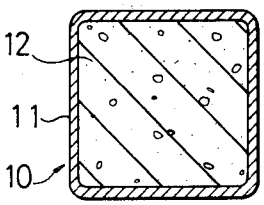
FIG. 5 is a cross sectional view of a column.
Figure 4:
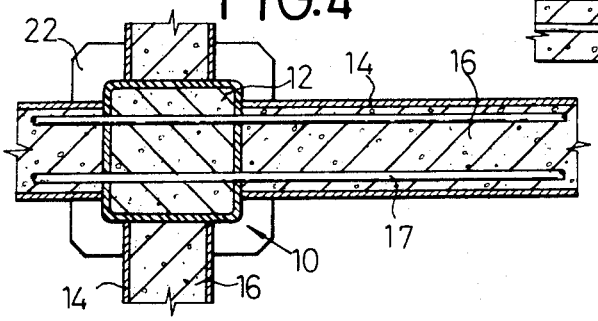
FIG. 4 is a fragmentary sectional plan view taken along the line 4—4 of FIG. 1.
Figure 6:
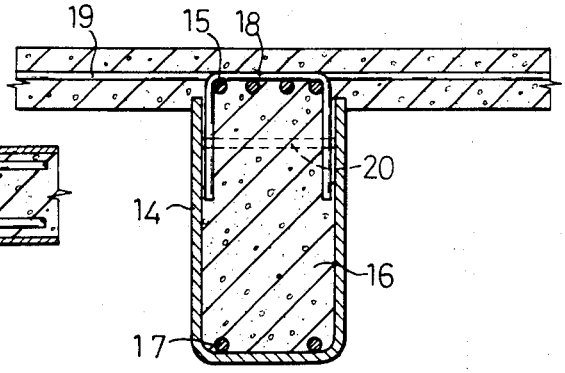
FIG. 6 is a fragmentary sectional view in elevation of a beam and a slab.

Description of the invention will begin with the first embodiment of the invention in conjunction with FIGS. 1–12. A column 10 consists of a steel tube 11 of square or circular cross section, with concrete or the like 12 filled in the steel tube 11. A beam 13 consists of a channel 14 which defines the outer configuration of the beam 13, upper steel bars 15, and concrete and the like 16 filled in the channel 14.

The channel 14 may be made by subjecting a steel plate to a welding, cold press or roll forming process, or it may be a U-section steel beam which is commercially available. The channel 14 is confined between the adjacent columns 10, and the end portions of the channel 14 are welded to the columns 10 respectively.

Placed on the bottom of the channel 14 are lower steel bars 17, and upper steel bars 15 are positioned just above top edges of the channel 14. The lower steel bars 17 and upper steel bars 15 extend entirely through the columns 10.

There are also provided inverted U-shaped bars 18 which extend from above the upper steel bars 15 into the channel 14. The inverted U-shaped bars 18 reinforce the concrete 16. As required, a deck plate (not shown) may be provided on the top portion of the channel 14. Also, as required, floor slab steel bars 19 may be provided above the channel 14. Alternatively, in place of the inverted U-shaped bars 18, the floor slab steel bars 19 may be positioned so as to support the upper steel bars 15. The lower steel bars 17 may be omitted, depending on the specific application of the invention.

Provided close to the open top side of the channel 14 are connecting members 20, such as long bolts or steel bars, which interconnect the opposite sidewalls of the channel 14 to prevent the channel 14 from being spread apart. Thus, the connecting member 20 serves as a shear connector between the channel 14 and the concrete 16.

A reinforcing band 21 is fitted about that portion of the column 10 through which the upper steel bars 15 extend to compensate for the cross sectional loss of the column area where the steel bars 15 intersect the column. Provided in contiguous relation to the under surface of the channel 14 is a stiffener ring 22 upon which the channel 14 is mounted to prevent a local deformation of the steel tube 11.

Figure 7:
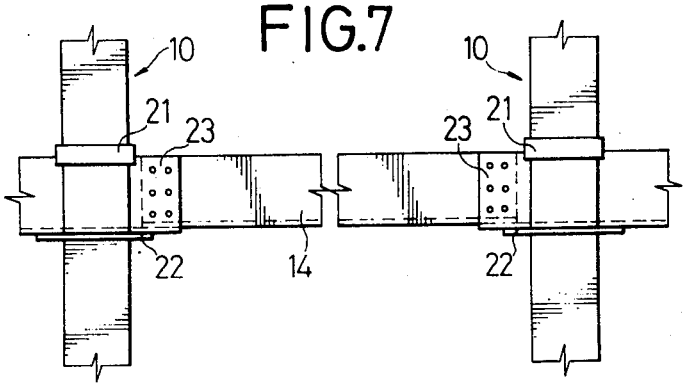
FIG. 7 is a fragmentary elevation view of a modification of the embodiment of FIG. 1.
Figure 8:
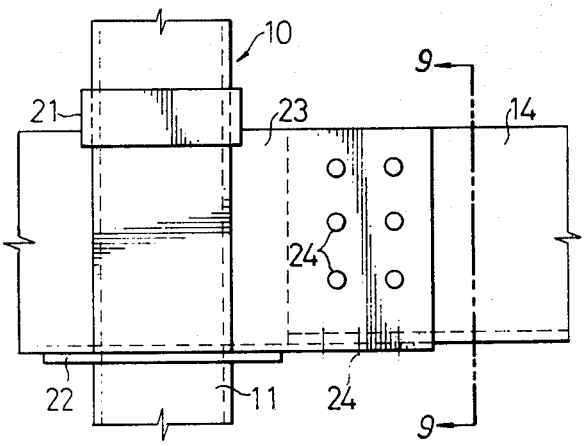
FIG. 8 is an enlarged fragmentary detailed view of a portion of the beam sheath and column shown in FIG. 7.
Figure 9:
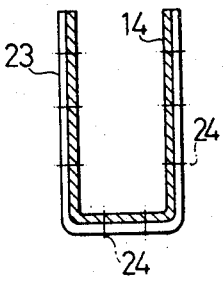
FIG. 9 is an elevational cross sectional view taken along the line 9—9 of FIG. 8.
Figure 11:
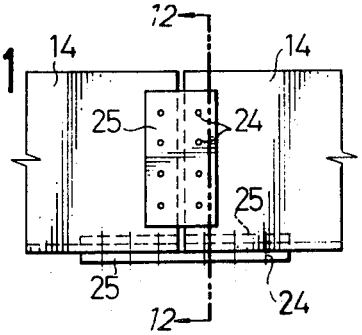
FIG. 11 is an enlarged fragmentary detailed view of a portion of a coupling of the beam sheath shown in FIG. 10.
Figure 10:
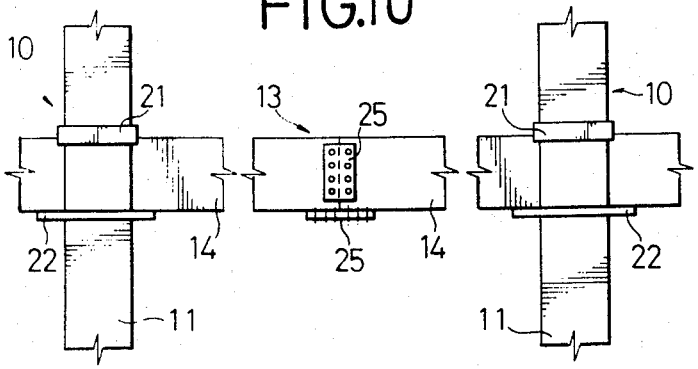
FIG. 10 is a fragmentary elevational view of another modification of the embodiment of FIG. 1.
Figure 12:
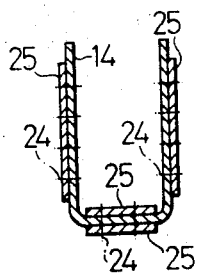
FIG. 12 is an elevational cross sectional view taken along the line 12—12 of FIG. 11.

As shown in FIGS. 7–9, the channel 14 may also be supported by prefabricating a U-shaped cross sectional bracket 23, by welding, to the side of the column 10, and then inserting the channel 14 in the bracket 23, after which the bracket 23 and channel 14 may be joined by means of high strength bolts or rivets 24. In another embodiment, the channels 14, as shown in FIGS. 10–12, may be welded to columns 10 and butt-jointed midway of the beam 13 with plates 25 and high strength bolts or rivets 24.

Concrete and the like 12 are filled in the steel tube 11 thus assembled, while concrete and the like 16 is also filled in the channel 14 and fire resisting coating is applied to the outer surfaces of the steel tube 11 and the channel 14, as required.

Figure 13:
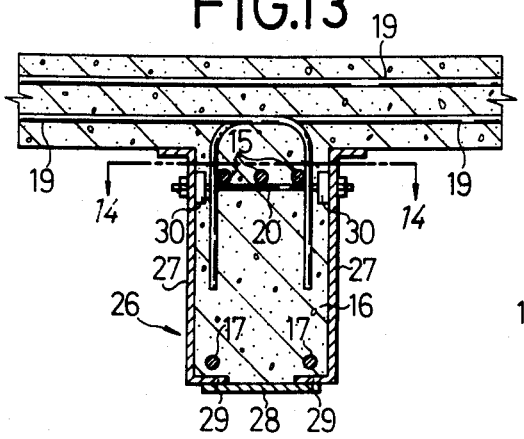
Figure 14:
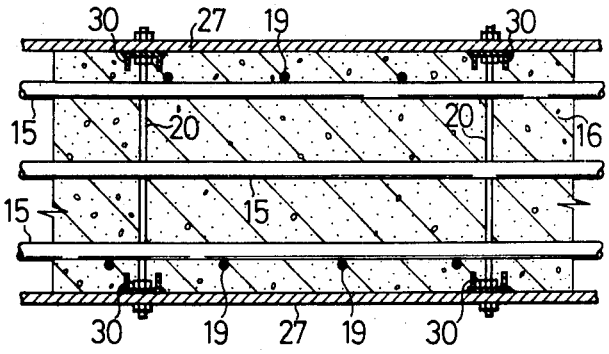
Figure 15:
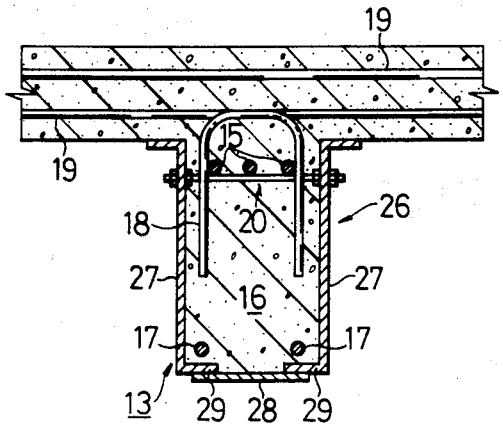

A second embodiment of the invention is shown in FIGS. 13–15, wherein a channel 26 consists of side member steel plates 27—27 and a boottom member steel plate 28. The side member plates 27—27 are Z-shaped in cross section, being provided with flange portions 29—29 opposed to each other. The lowermost flange portions 29—29 are coupled to each other by means of bottom member steel plate 28 by welding or by means of bolts. The connecting member 20 is provided with concrete ties 30—30 by welding contiguous to the opposed inner surfaces of the side member steel plates 27—27. The ties 30—30 augment the bonding strength between the side member plates 27—27 and the concrete 16.

According to this second embodiment of the invention, the channel 26 may be fabricated and, prior to shipping, side member steel plates 27—27 and bottom member steel plate 28 are disassembled for ease of handling and transportation.

Figure 16:
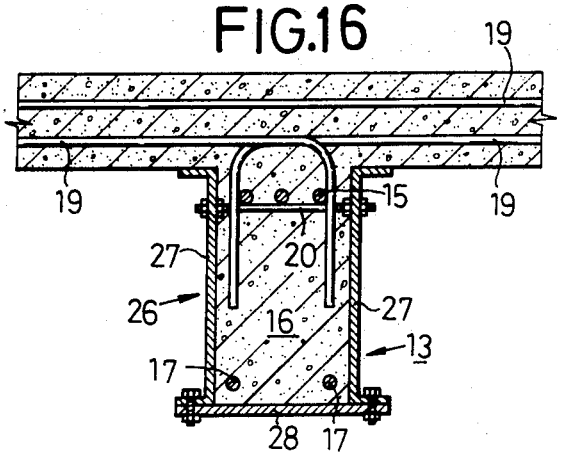

In FIG. 16 the side member plates 27—27, shown in cross section, are assembled in the form of a channel with bottom member plate 28. The upper and lower flanges of the plates 27—27 are directed outwardly from their respective web portions, and the bottom plate 28 is interconnected with the lower flanges of the first plates 27.

Figure 17:
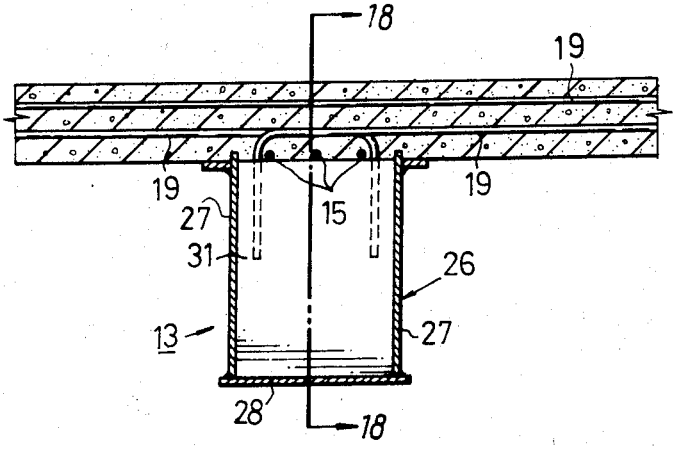
Figure 18:
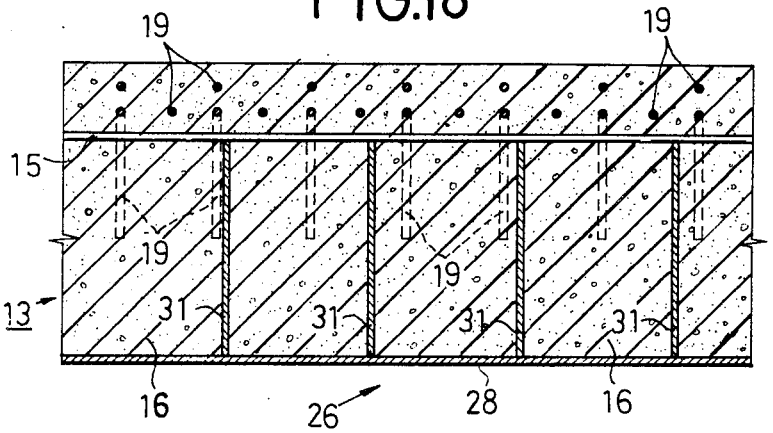
Figure 19:
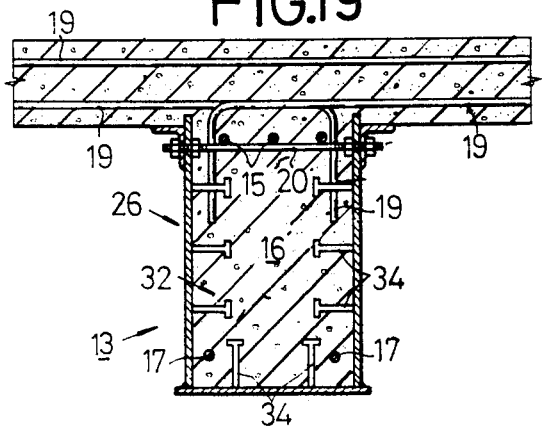
Figure 20:
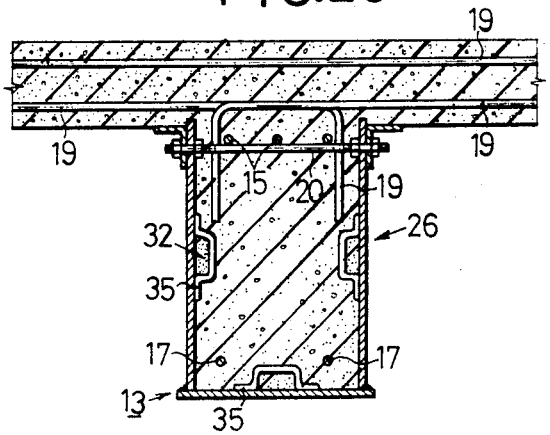
Figure 21:
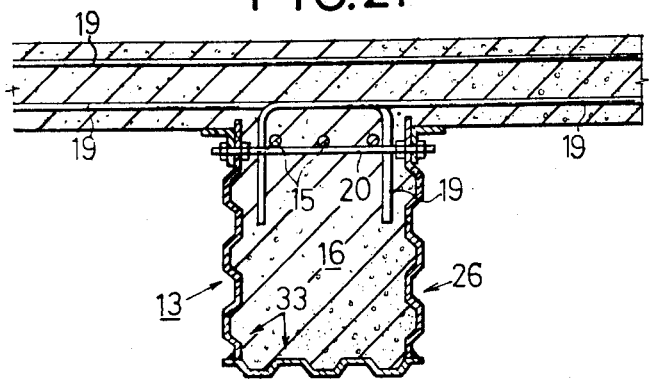

FIGS. 17 and 18 show the third embodiment of the invention. A plurality of steel gusset plates 31 are transvesely positioned and longitudinally spaced in the channel 26, and securely fixed to the side member plates 27 and the bottom member plate 28. Two or more steel bars 15 rest on the upper edges of steel gusset plates 31. For better bonding with the concrete 16, gusset plates 31 may be given surface irregularity (not shown) as required. In the embodiment of FIGS. 17 and 18, shearing of the concrete 16 relative to the channel 26 and buckling of the side member steel plates 27—27 is effectively prevented by the gusset plates 31. In addition, gusset plates 31 define the spacing of the side member steel plates 27—27 as well as the upper steel bars 15. Furthermore, the gusset plates 31 serve as fixtures to fabricate the channel 26.

Figure 22:
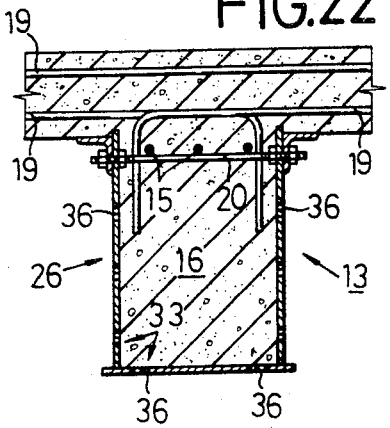
Figure 23:
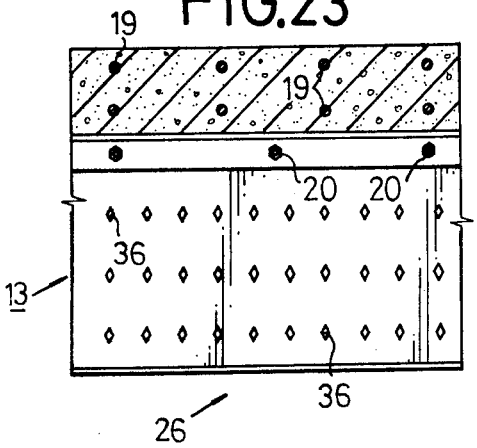

FIGS. 19–23 show the fourth embodiment of the invention. Formed on the inner surfaces of the channel 26 are inwardly projecting tie members 32. The walls of the channel 26 are corrugated so as to provide concave and convex surfaces as shown at 33. The projecting tie members may be provided in the form of stud bolts 34 welded to the inner surface of the channel 26. In addition to stud bolts 34 projecting tie members such as ears or lugs 35 may be welded to channel 26. In addition, as shown in FIGS. 22 and 23, the channel 26 may be made of an expandable metal in which a plurality of vertical slits are provided therein, and then the steel plate is stretched in the lateral direction so as to spread the slits open as at 36. According to this embodiment of the invention, the projecting members 32 and corrugated wall 33 serve as shear connectors, thereby improving the bond of the channel 26 with the concrete 16.

Figure 24:
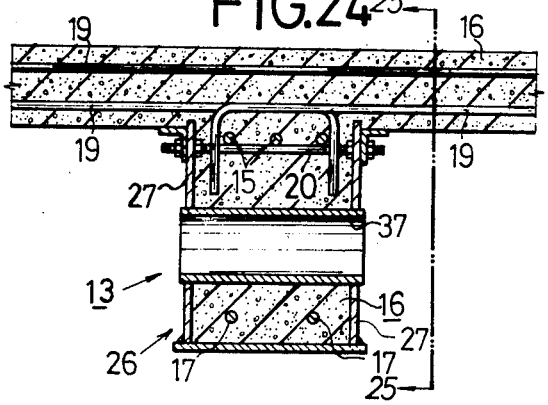
Figure 25:
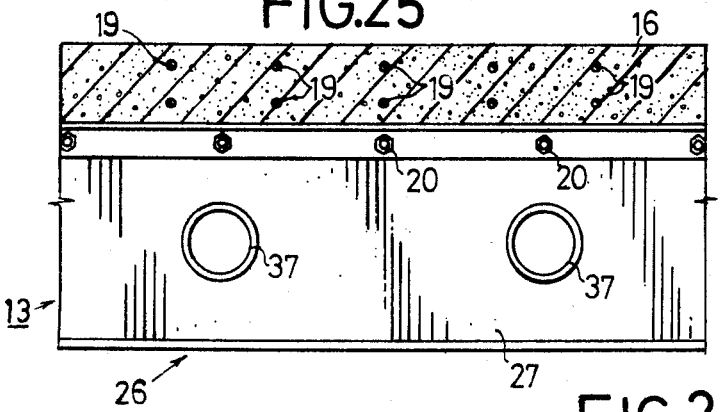

FIGS. 24 and 25 show the fifth embodiment of the present invention in which two or more steel tubes 37 extend through and are welded to side member steel plates 27—27 of the channel 26.

Figure 26:
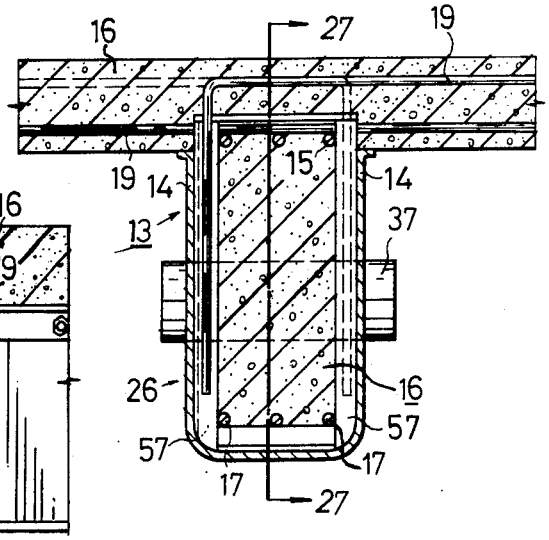
Figure 27:
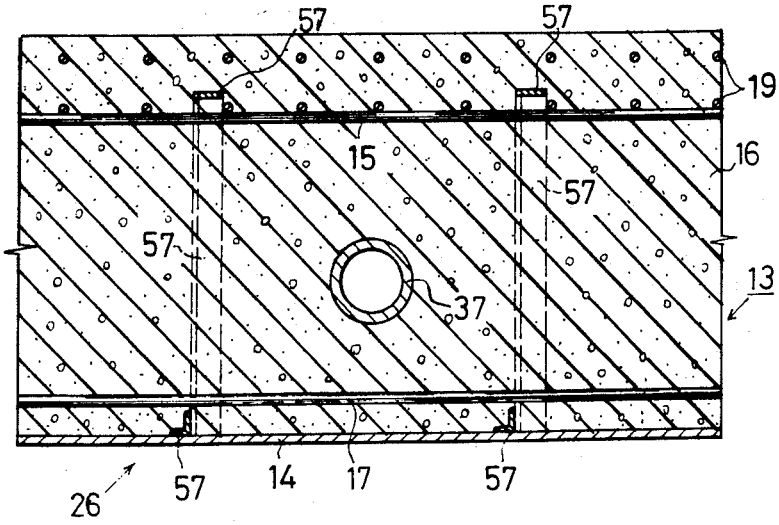

As shown in FIGS. 26 and 27, a plurality of frame-like steel members 57 may be positioned and welded along the length of the channel 26 with a predetermined spaced relationship to each other, for connecting the opposite sidewalls of the channel 26 to prevent sidewall deflection. Sleeve 37 serves to prevent buckling of side member steel plates 27—27, and to prevent the shifting of channel 26 relative to the concrete 16, thus providing a beam 13 having high strength, stiffness and high yield strength. Furthermore, the through hole formed in beam 13 by steel tube 37 may be used as an air conditioning duct, water passage, conduits for electric wires and cables, and the like. This feature provides considerable flexibility in design options.

Figure 28:
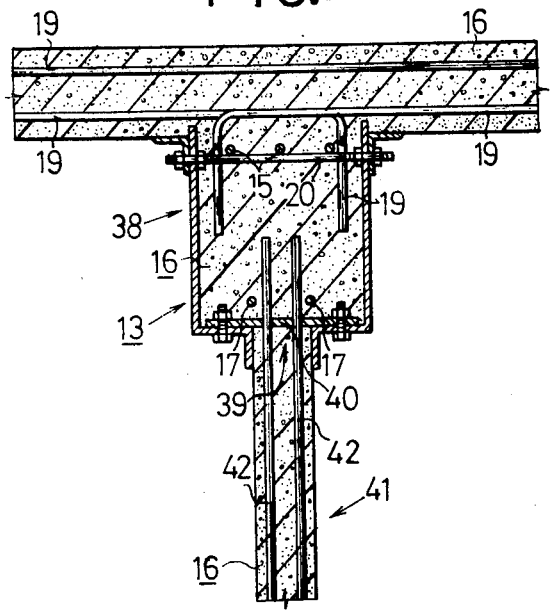
FIG. 28 is a fragmentary elevational cross sectional view showing the coupling of a beam, slab and wall in a sixth embodiment of the invention.

FIG. 28 shows the sixth embodiment of the invention in which channel 38 is formed with a longitudinal opening 39 extending along the length of the channel. Two or more tie members 40 are provided so as to interconnect and space apart the bottom edges of the sidewalls to form the opening 39. Steel bars 42 project upwardly from the wall 41 into the channel 38 and concrete 16 interconnects in the channel 38 and the wall 41 to add stiffness and strength to the structure.

Figure 29:
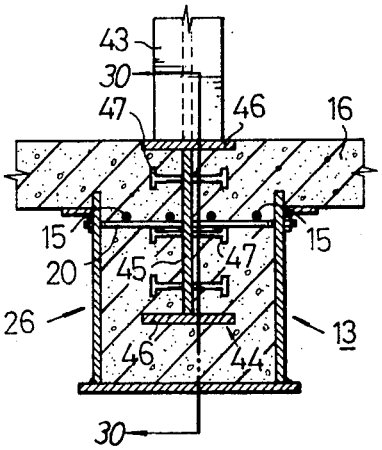
Figure 30:
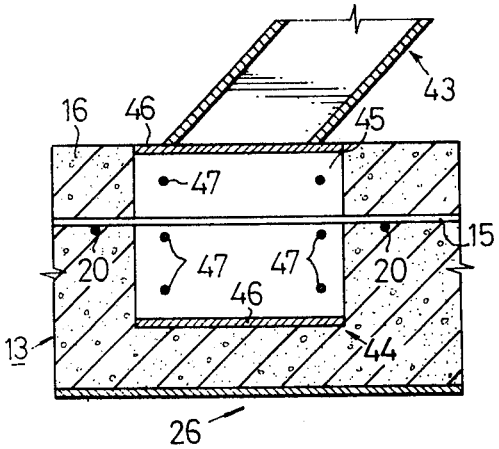
Figure 31:
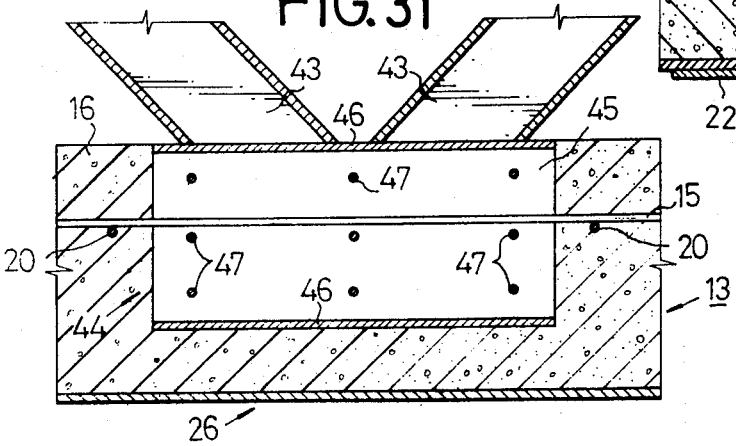

FIGS. 29–31 show the seventh embodiment of the invention in which an anchor member 44 is connected to the tip portion of a diagonal girder 43. The anchor member 44 consists of a web 45 and flanges 46—46 to form an I-shaped section steel member. The web 45 is formed with projecting pieces 47 made of stud bolts, steel bars or other metal projections. The anchor member 44 is positioned within the beam 13 and concrete 16 is filled in the beam 13 to embed the anchor member 44 therein.

Figure 32:
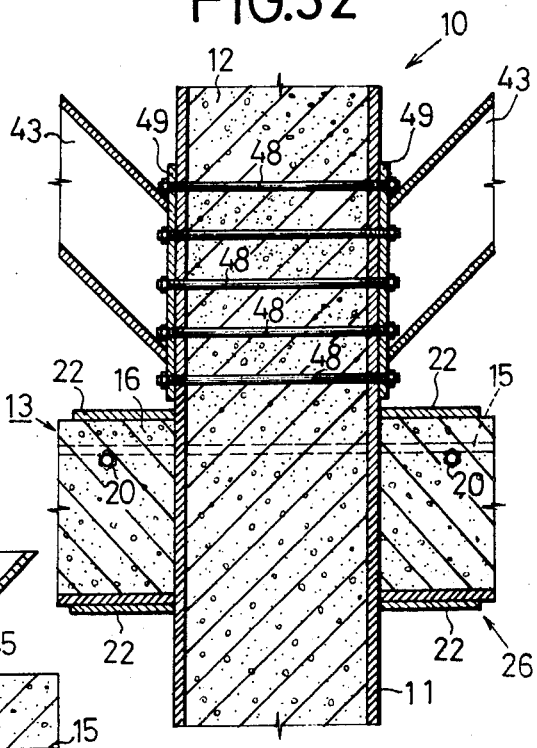
Figure 33:
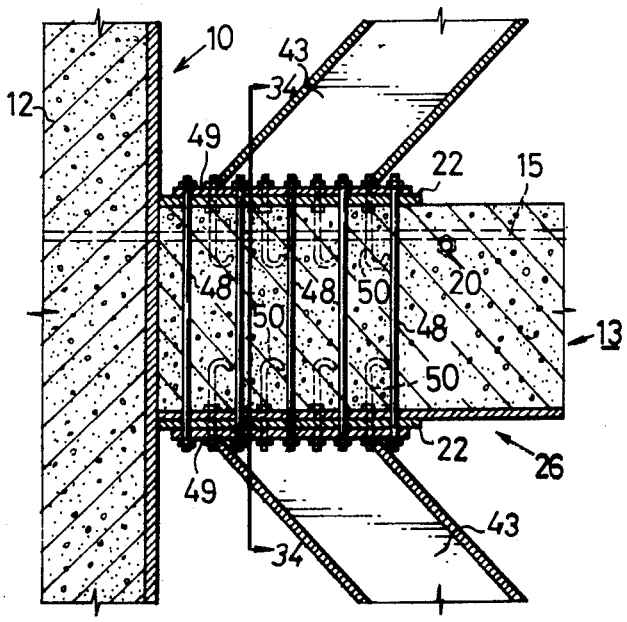
Figure 34:
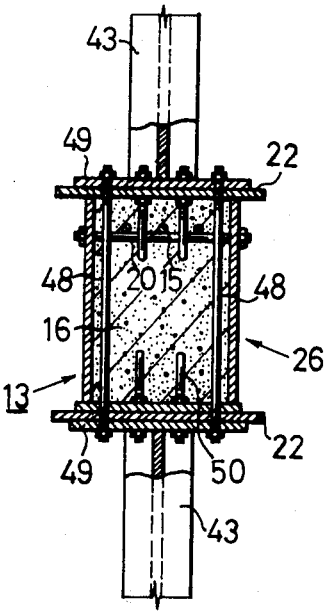

FIGS. 32–34 show the eighth embodiment of the invention. As shown in FIG. 32, end plates 49—49 are welded to the tip portions of the symmetrically aligned diagonal bracings 43—43. The end plates 49—49 in turn are attached to the opposite sides of steel tube 11 by means of long bolts 48.

FIGS. 33 and 34 illustrate a modification of the embodiment of FIG. 32, wherein two or more anchor bolts 50 extend through the end plates 49—49. The end plates 49—49 are also fastened to the beam 13 by means of long bolts 48.

Figure 35:
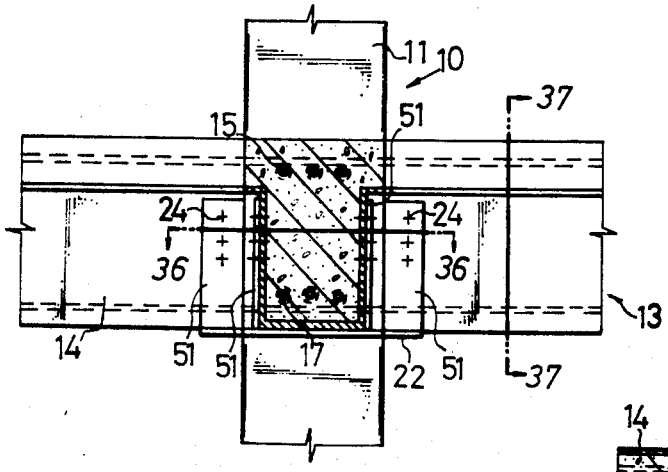
Figure 36:
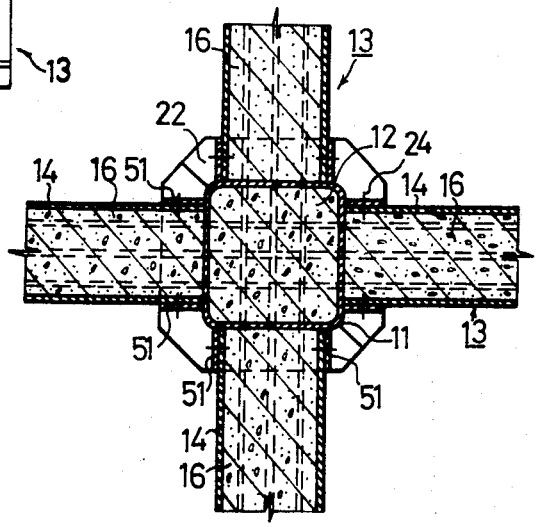
Figure 37:
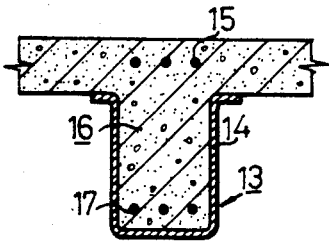

FIGS. 35–37 show the ninth embodiment of the invention, wherein the column 10 consists of a steel tube 11 filled with concrete 16. Ring stiffener 22 extends from the outer periphery of the column 10 in the horizontal direction. Gusset plates 51—51 project from the column 10 above ring stiffener 22 at a given spacing. The end portion of channel 14 is positioned between the gusset plates 51—51 and the sidewalls of channel 14 are connected to the gusset plates 51—51 by means of bolts and nuts, or by welding. Upper steel bars 15 and lower steel bars 17 are embedded in concrete within channel 14 and extend through column 10. The ring stiffener 22 may be of a split type as shown in FIG. 36, and the halves may be brought into abutment with each other and welded.

Figure 38:
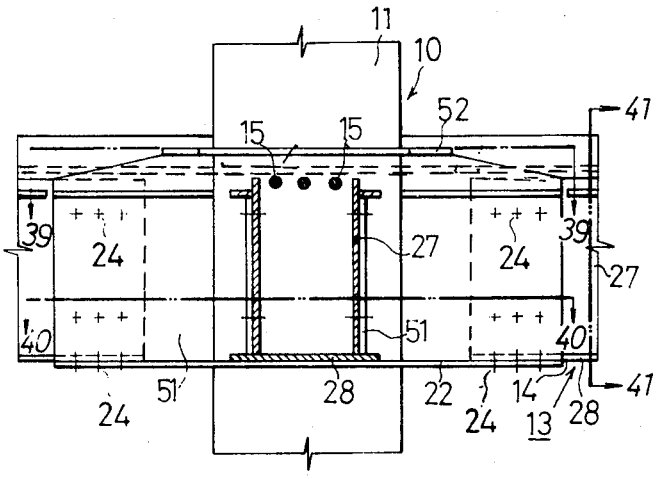
Figure 39:
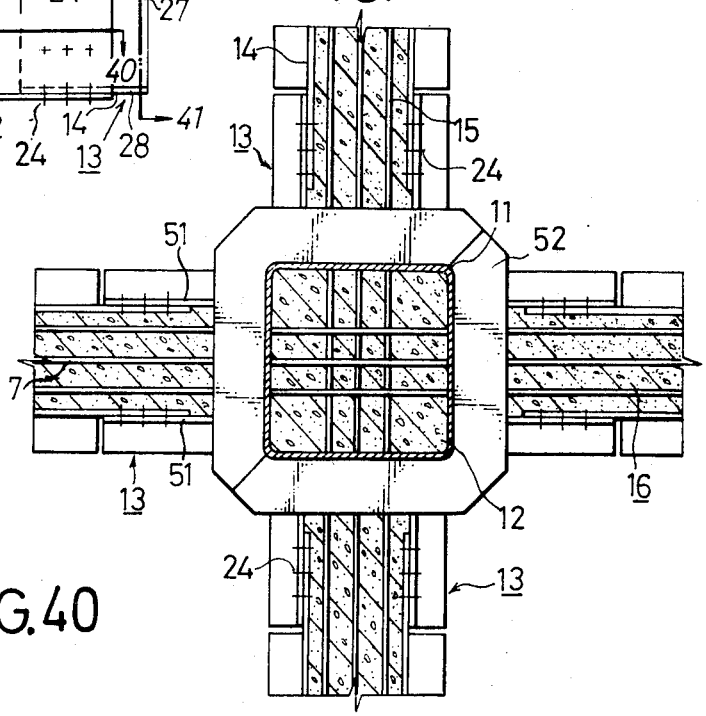
Figure 40:
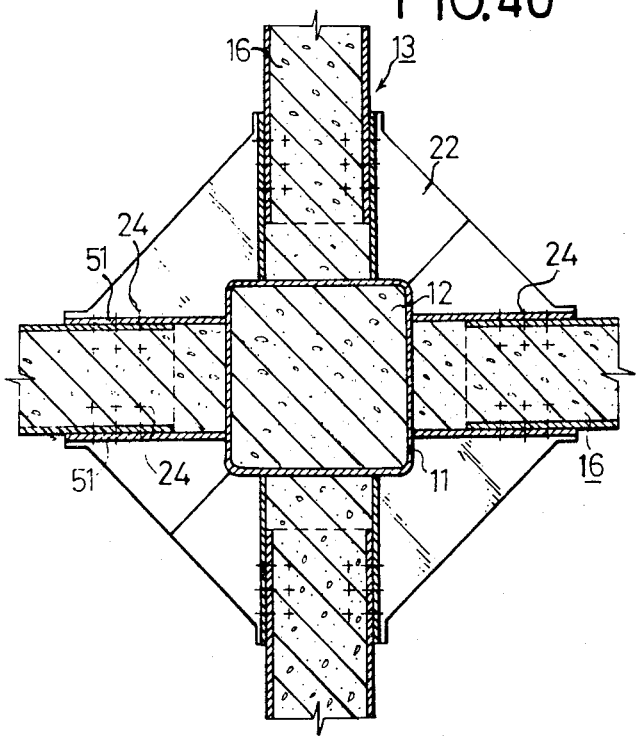
Figure 41:
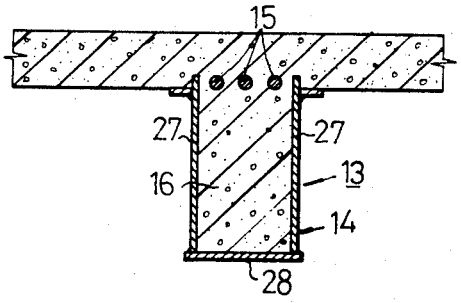
Figure 42:
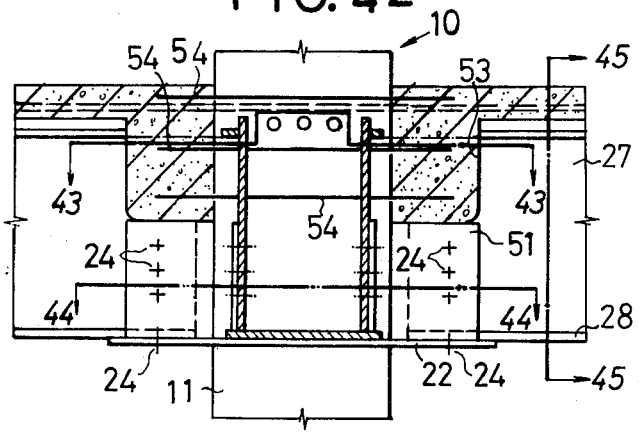
FIG. 42 is a fragmentary elevational partial cross sectional view showing the coupling of a beam and a column.
Figure 43:
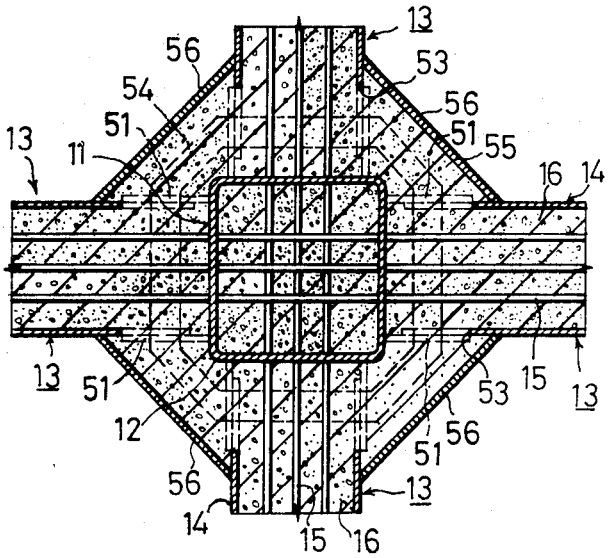
FIG. 43 is a fragmentary cross sectional plan view taken along the line 43—43 of FIG. 42.
Figure 44:
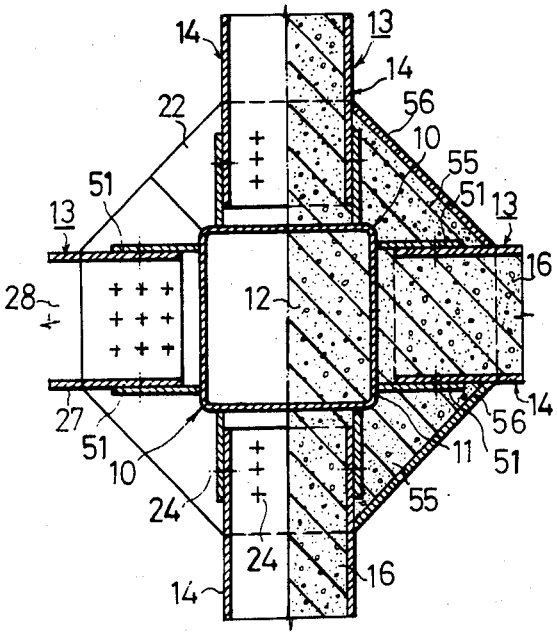
FIG. 44 is a fragmentary elevational horizontal cross sectional view taken along the line 44—44 of FIG. 42.
Figure 45:
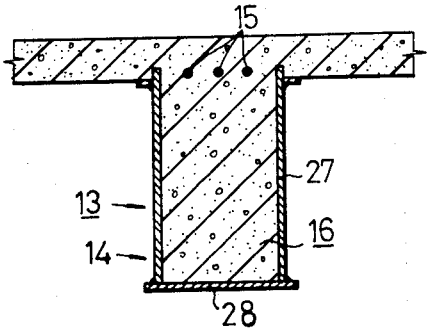
FIG. 45 is a fragmentary elevational cross sectional view taken along the line 45—45 of FIG. 42.

FIGS. 38–41 show the tenth embodiment of the invention which adds an upper ring stiffener 52 to the arrangement of the ninth embodiment to couple the top portions of the gusset plates 51—51 to the column 10. The channel 14 is connected to the gusset plates 51—51 and also to the ring stiffener 22 with high strength bolts 24, as shown in FIG. 38.

FIGS. 42–45 show the eleventh embodiment of the invention, which adds to the arrangement of the ninth embodiment a cut-away portion 53 defined in the upper portion of the sidewall of the channel 14 to permit steel bars 54 to encircle the outer periphery of the column 10, and concrete 16 or the like 55 is filled therein in a manner to embed the surrounding steel bars. The concrete 16 is held in place by forms 56. The channel 14 is connected to the ring stiffener 22 and gusset plate 51 by means of high strength bolts 24.

The steel plates as used in the column and beam according to the present invention serve as both structural members and forms for concrete. This dispenses with complicated operations for preparing forms for pouring concrete for columns and beams and simplifies the operation of arranging steel bars for the structure, as compared with an ordinary steel bar reinforced concrete structure. From a structural viewpoint, the provision of the steel plates which sheath the concrete and the like increases the stiffness and yield strength of the joints and hence those of the structure. The stresses acting on the joints between the column and beam are carried therethrough in a manner that the shear force is carried through the opposed walls of a beam connected to the steel tube of a column, while the upper steel reinforcing rods and bottom steel plate resist the bending moment. For this reason, desired rigidity is achieved for the joints of the structure. The exposed surfaces of a steel tube and beam sheath should be coated with fire resisting materials as in the case of the steel frame construction. However, since concrete is filled therein, the heat resistant capacity of the structure is increased, so that the amount of fire resisting material or coating may be reduced by half or more, as compared with the case of an ordinary steel frame construction.

As is apparent from the foregoing description, the operation at a construction site is simplified with saving in expenditure of time and effort, thus leading to accelerated progress of the construction and reduction in cost. It will be understood that the above description is merely illustrative of preferred embodiments of the invention. Additional modifications and improvements utilizing the discoveries of the present invention can be readily anticipated by those skilled in the art from the present disclosure, and such modifications and improvements may fairly be presumed to be within the scope and purview of the invention as defined by the claims that follow.

Having thus described the invention, it is claimed:

1. A building structure comprising:

(a) a concrete filled steel tube column;

(b) a first ring stiffener connected to the outer periphery of said column to project horizontally therefrom;

(c) a vertical gusset plate projecting from said column above said first ring stiffener;

(d) a U-shaped channel connected to said gusset plate above said first ring stiffener, said U-shaped channel having cut-away portions defined in the ends of its upper side portions;

(e) steel reinforcing rods positioned in said channel and extending through said column;

(f) a steel reinforcing rod ring encircling the outer periphery of said column within said cut-away portions;

(g) said first ring stiffener and the bottom portion of said channel being securely connected to each other; and (h) concrete filled in said channel and concrete embedding said steel reinforcing rod ring.

2. A building structure as set forth in claim 1, including a second ring stiffener positioned to couple the top portion of said gusset plate to said column.

* * * * *